US008821278B2

(12) United States Patent
Gagner et al.

(10) Patent No.: US 8,821,278 B2
(45) **Date of Patent: *Sep. 2, 2014**

(54) GAMING SYSTEM HAVING CONTROLLABLE DYNAMIC SIGNAGE

(75) Inventors: Mark B. Gagner, West Chicago, IL (US); Damon E. Gura, Chicago, IL (US); Craig J. Sylla, Round Lake, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 202 days.

This patent is subject to a terminal disclaimer.

(21) Appl. No.: 13/523,375

(22) Filed: Jun. 14, 2012

(65) Prior Publication Data

US 2012/0252566 A1 Oct. 4, 2012

Related U.S. Application Data

(63) Continuation of application No. 12/674,619, filed as application No. PCT/US2008/010185 on Aug. 28, 2008, now Pat. No. 8,251,816.

(60) Provisional application No. 60/994,781, filed on Sep. 21, 2007.

(51) Int. Cl.
*G07F 17/32* (2006.01)

(52) U.S. Cl.
USPC ..... 463/31; 463/16; 463/20; 463/25; 463/29

(58) Field of Classification Search
USPC ..... 463/16, 20, 25, 239, 31, 29
See application file for complete search history.

(56) References Cited

U.S. PATENT DOCUMENTS

| | | | | |
|---|---|---|---|---|
| 8,109,821 | B2 | 2/2012 | Kovacs et al. | 463/16 |
| 2002/0183105 | A1 * | 12/2002 | Cannon et al. | 463/16 |
| 2006/0063583 | A1 | 3/2006 | Thomas | 463/20 |

OTHER PUBLICATIONS

PCT International Search Report for International Application No. PCT/US2008/010185 dated Nov. 17, 2008 (2 pages).
PCT International Written Opinion for International Application No. PCT/US2008/010185 dated Nov. 17, 2008 (4 pages).

* cited by examiner

*Primary Examiner* — Omkar Deodhar
(74) *Attorney, Agent, or Firm* — Nixon Peabody LLP

(57) ABSTRACT

A gaming system comprises a first gaming device displaying a first primary wagering game in response to receipt of a first wager from a first player and a second gaming device displaying a second primary wagering game in response to receipt of a second wager from a second player. The system further comprises a community display having a plurality of display regions thereon, and at least one controller operative to (i) detect activation of a first supplemental feature by the first player, (ii) detect activation of a second supplemental feature by the second player, (iii) determine in which of the plurality of display regions to display the first and second supplemental features in accordance with at least a first rule set, and (iv) display the first and second supplemental features on the community display.

19 Claims, 7 Drawing Sheets

GAMING SYSTEM HAVING CONTROLLABLE DYNAMIC SIGNAGE

CROSS REFERENCE TO RELATED APPLICATIONS

This application is a continuation of U.S. patent application Ser. No. 12/674,619, titled "Gaming System Having Controllable Dynamic Signage" and filed Feb. 22, 2010, now allowed, which is a U.S. national stage of International Application No. PCT/US2008/010185, titled "Gaming System Having Controllable Dynamic Signage" and filed Aug. 28, 2008, which claims priority to U.S. Provisional Patent Application Ser. No. 60/994,781, titled "Gaming System Having Controllable Dynamic Signage" and filed on Sep. 21, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having controllable dynamic signage.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Other gaming systems have employed various types of signage for displaying game information and advertising game play and features. Signage has included individual displays mounted on or near various gaming devices, as well as signage in the form of central or community displays positioned in various locations throughout casinos. The present invention is directed toward a gaming system having controllable dynamic signage.

SUMMARY OF THE INVENTION

According to one aspect of the present invention, a gaming system comprises a first gaming device displaying a first primary wagering game in response to receipt of a first wager from a first player and a second gaming device displaying a second primary wagering game in response to receipt of a second wager from a second player. The system further comprises a community display having a plurality of display regions thereon, and at least one controller operative to (i) detect activation of a first supplemental feature by the first player, (ii) detect activation of a second supplemental feature by the second player, (iii) determine in which of the plurality of display regions to display the first and second supplemental features in accordance with at least a first rule set, and (iv) display the first and second supplemental features on the community display.

According to another aspect of the invention, gaming system comprises at least one gaming device displaying at least one primary wagering game in response to receiving a primary wager, the at least one gaming device further offering a plurality of activatable supplemental features. The system further comprises at least one community display having a plurality of display regions thereon, and an operator control computer in communication with the at least one gaming device and the at least one community display. The operator control computer comprises memory storing at least a first rule set for controlling the plurality of display regions and resolving which of the plurality of activatable supplemental features is displayed in each of the plurality of display regions.

According to yet another aspect of the invention, a method of operating a wagering game comprises receiving a first primary wager from a first player, and in response thereto, displaying a first primary wagering game and receiving a second primary wager from a second player, and in response thereto, displaying a second primary wagering game. The method further comprises receiving a first side bet from the first player, and in response thereto, activating the first player to participate in a first supplemental feature, and receiving a second side bet from the second player, and in response thereto, activating the second player to participate in the first supplemental feature. The method further comprises displaying the first supplemental feature, wherein a first portion of the first supplemental feature is displayed on a first community display and a second portion of the first supplemental feature is displayed on a second community display, wherein the first and second portions comprise a coordinated presentation.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
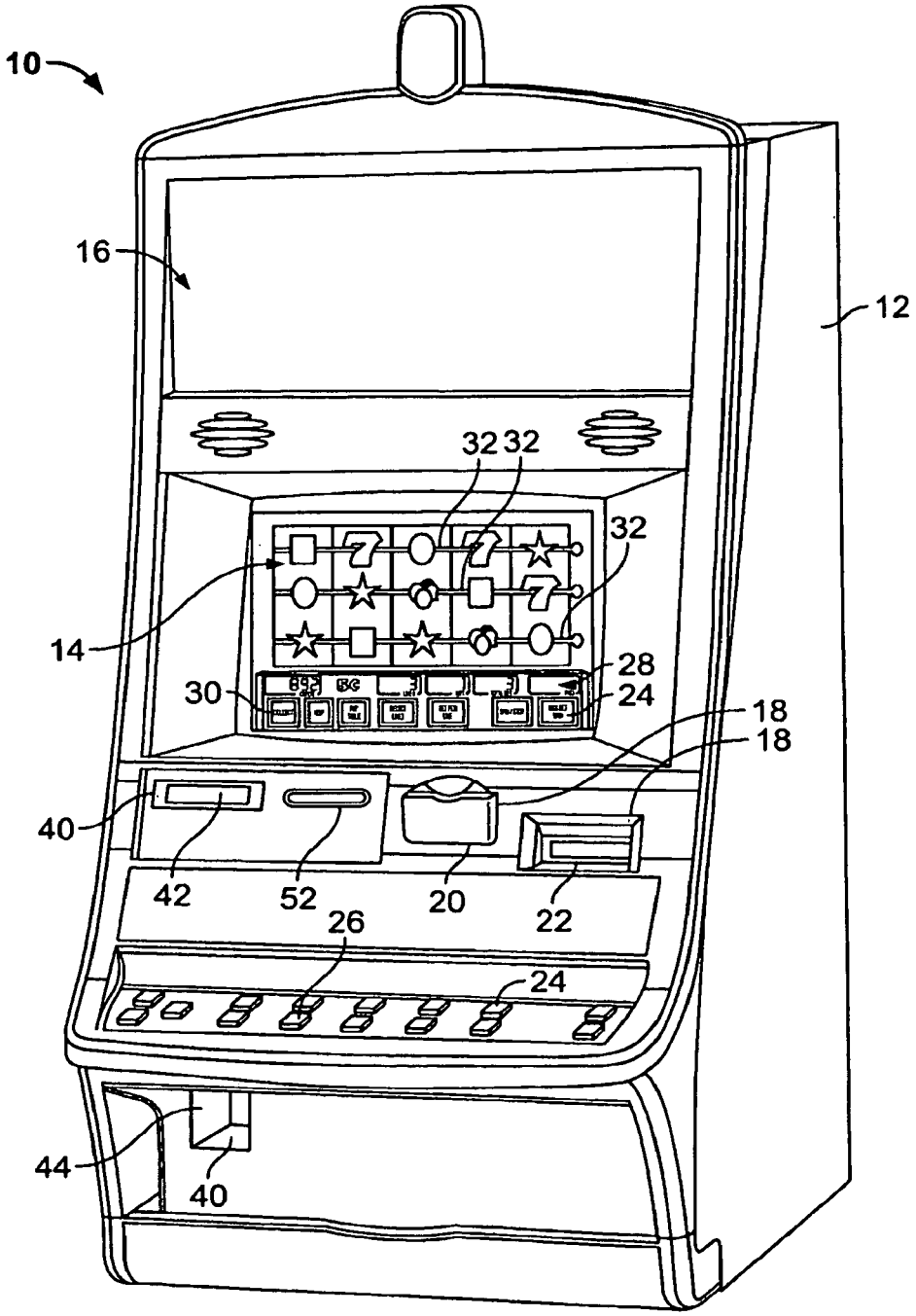
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
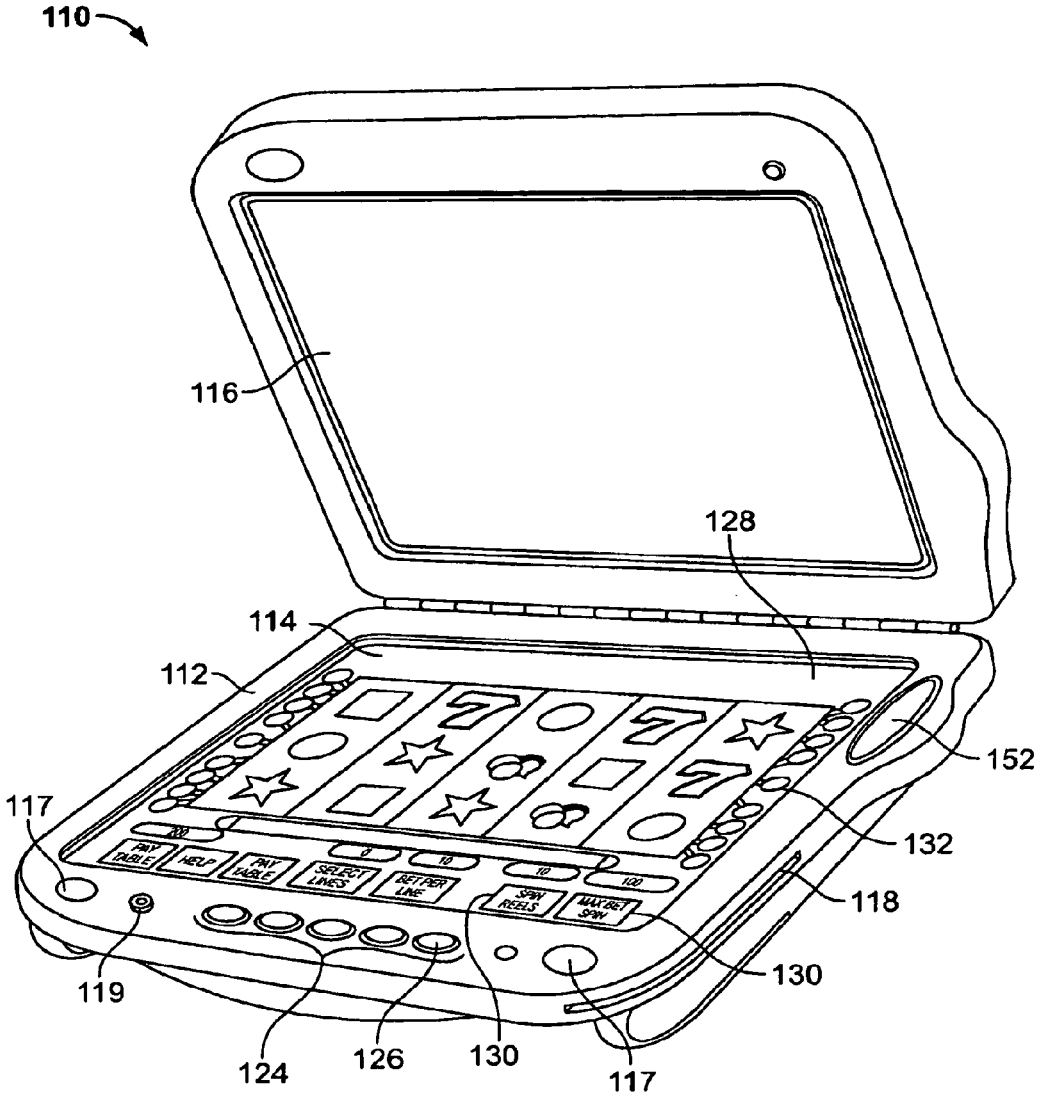
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
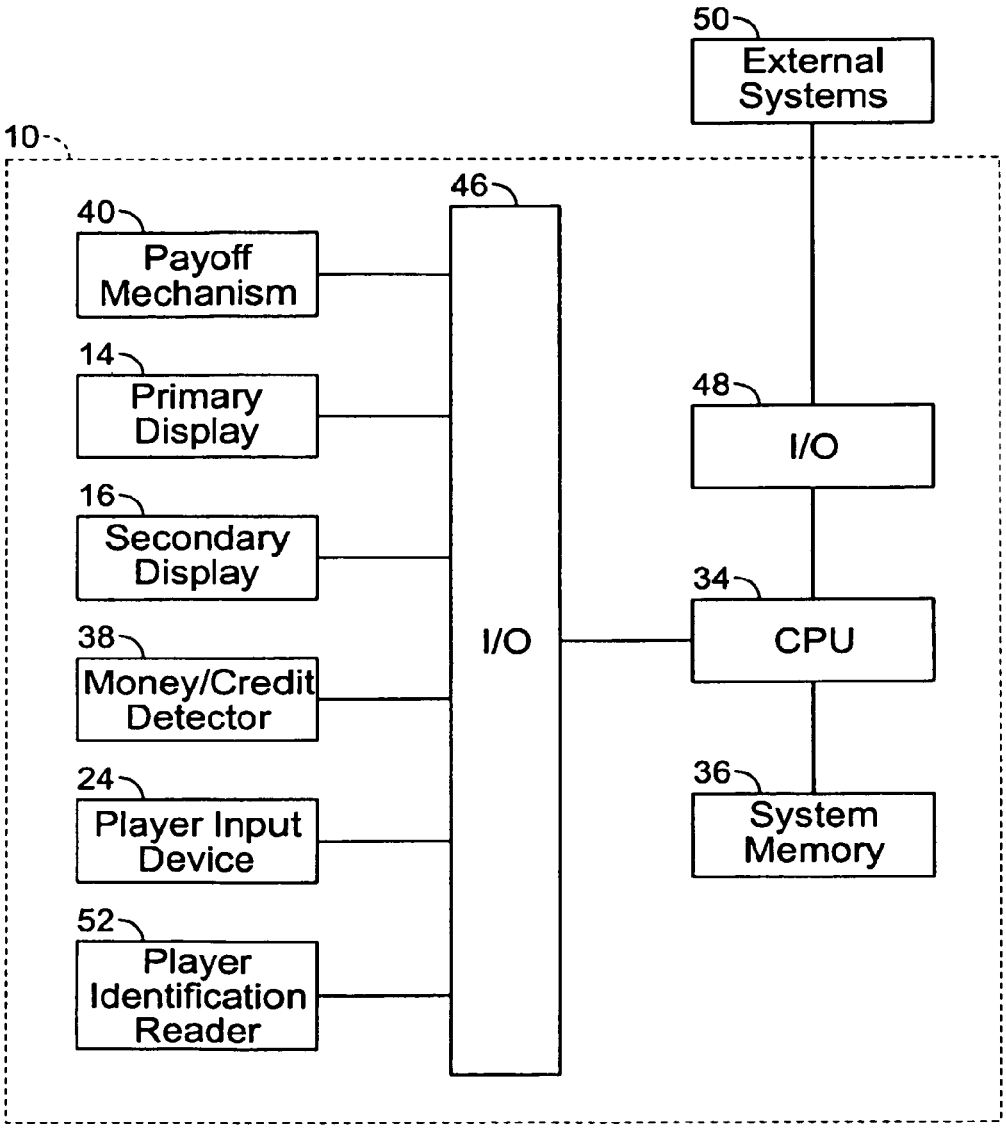
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RING)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
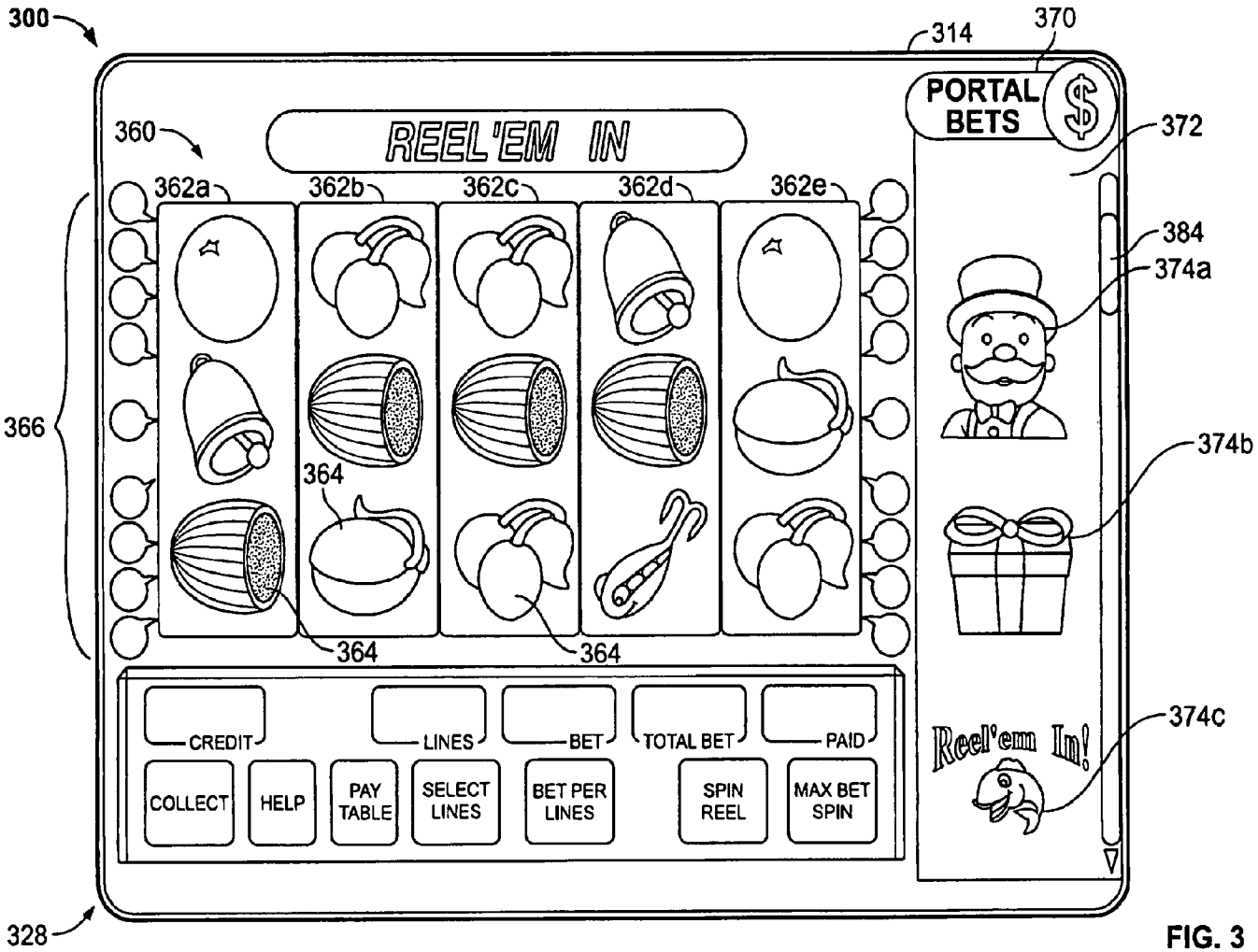
FIG. 3 is a screen shot of a gaming device of a gaming system including activatable supplemental features.

Turning now to FIG. 3, a primary display 314 of a gaming system 300 is shown. The primary display 314 may be any form of display such as those described herein with reference to the free standing and handheld gaming devices of FIGS. 1*a* and 1*b*. The primary display 314 includes display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol, or empty space. As described herein the symbols 364 landing on the active paylines 332 (the paylines for which a wager has been received) are evaluated for winning combinations. If a winning combination of symbols 364 lands on an active payline 332 a primary award is awarded in accordance with a pay table of the gaming device. The symbols 364 on the reels 362*a,b,c,d,e* form an array 366 or matrix of symbols 364, having a number of rows and columns, which in the embodiment shown is four rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

The system 300 further includes a feature icon 370 for displaying and receiving selection and activation of various supplemental or bonus features to the wagering game 360. The feature icon 370 in FIG. 3 comprises a graphical icon or button entitled "Portal Bets." In other embodiments, other icons or graphics may be utilized, and may include isolated buttons, icons, or even a graphical bar or menu, for example across the top, bottom, or side of the display 314. The feature icon 370 can be selected or activated by a player of the wagering game 360 through a touch screen 328 overlying the display 314, or through any other appropriate player input device as described herein with relation to FIGS. 1*a*, 1*b* and 2. In FIG. 3, the player is seen activating the feature icon 370 by selecting it via the touch screen 328.

Figure 4:
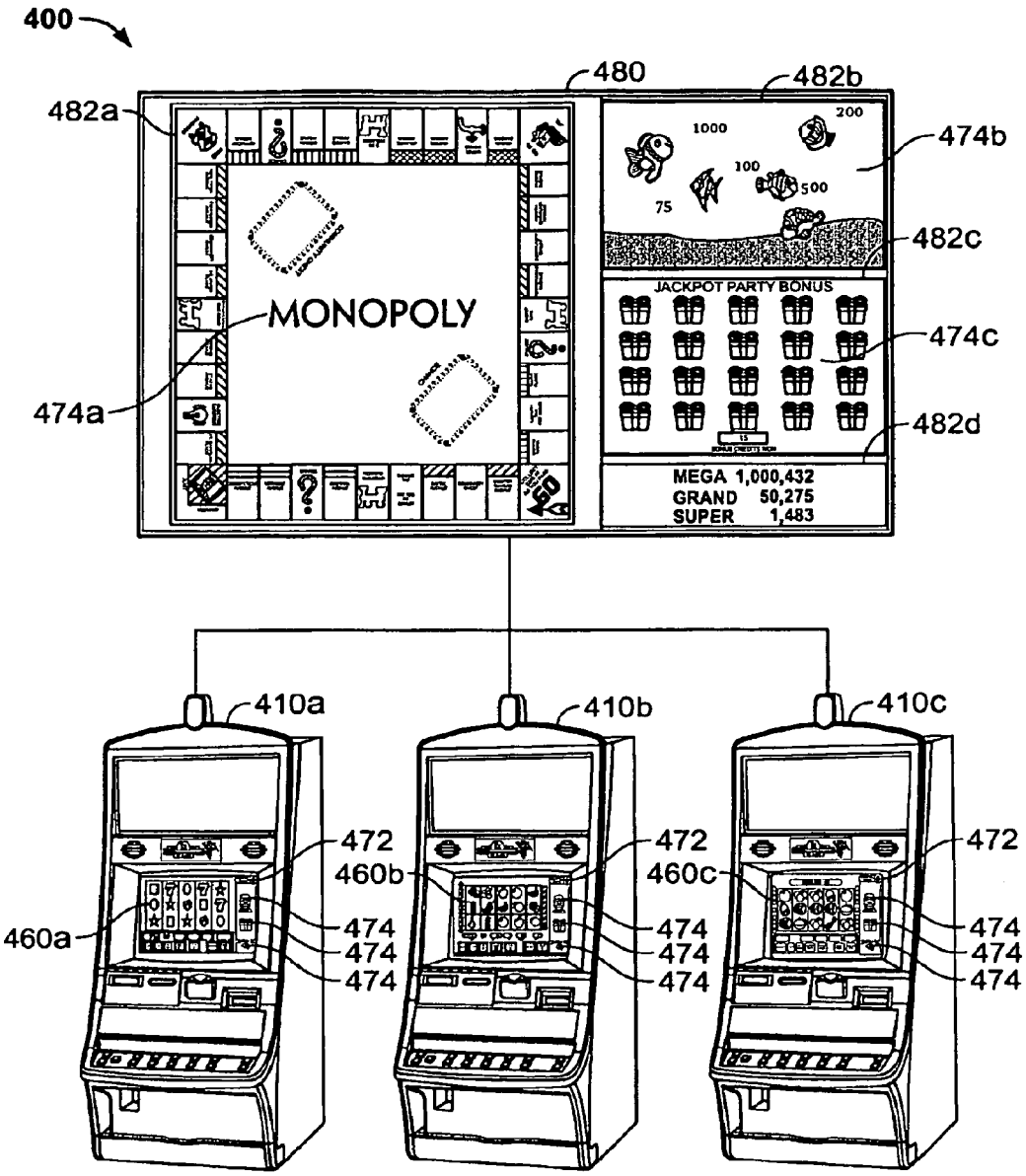
FIG. 4 is a diagram of a gaming system having controllable dynamic signage.

Once the feature icon 370 has been selected or activated, a feature menu 372 is displayed on the primary display 314 of the system 300. The feature menu 372 includes a plurality of available bonus features 374 which are provided for activation or selection in addition to the primary wagering game 360. In FIG. 4, three available features 374*a,b,c* are shown which correspond to three different themed features, a Monopoly feature 374*a*, a Jackpot Party feature 374*b*, and a Reel 'Em In feature 374*c*. Any one or more of the features 374*a,b,c* displayed may be activated by a player, in this embodiment, by touching the touch screen 328 at an appropriate location to select the desired feature or features 374*a,b,c*. In an embodiment, selection and activation of one of the features 374 requires input of an additional wager in the form of a secondary wager, side bet, or other monetary input. Thus, in one embodiment, selection of a desired feature 374 causes a player's wager account to be debited in an appropriate amount associated with the feature. In an alternative embodiment, one or more of the features 374 may be activated or selected without placing additional wagers or incurring additional fees. In yet another alternative embodiment, the cost of additional features 374 may be debited from or supplied by player loyalty points, frequent player points, comps, player tracking card points, a designated feature fund, or other collected secondary economy accounts, instead of or in addition to currency wagers.

In addition, the feature menu 372 includes a menu controller 384 for scrolling through visible and obscured selections. In this embodiment, the menu controller 384 is a scroll bar depicted on the right edge of the feature menu 372. For example, when the feature icon 370 is first selected, some of the plurality of available features 374 are displayed while others are obscured as being lower in the feature menu 372 window. The slider bar 384 may be utilized to scroll or slide down within the window of the feature menu 372 so as to reveal previously obscured features 374 which are available. In alternative embodiments, many other menu controllers 384 may be utilized instead of or in addition to the scroll bar. For example, the menu controller 384 may comprise a knob, wheel, joystick, or other physical controller such as Up and Down arrows or keys. Moreover, the menu controller 384 may comprise soft key equivalents of these physical devices, such as a virtual knob, dial, page up button, page down button, arrows, wheels, roller balls, etc. which receive inputs through the touch screen 328 controlling movement of the features 374 in the feature menu 372.

The features 374 available for activation may take on many different forms, and are available to players in addition to one or more basic wagering games 360 of the system 300. Any number of wagering game features 374 are available to be activated by a player of the gaming system 300. The features 374 may include any number of improvements, additions, enhancements, or modifications of a standard basic wagering game experience displayed on the primary display 314. For example, the features 374 may include eligibility or participation in bonus games, progressive jackpots or awards, community games or events, including group games, team competitions, and competitive or collaborative play. The features 374 may also include wagering game assets such as free spins, wild symbols, multipliers, symbol upgrades, expanding wild symbols, scatter symbols, etc. The features 374 may also include eligibility or participation in secondary wagering games, side-bet games, reel re-spins, or extra chances or opportunities during play of the primary wagering games.

In other embodiments, the features 374 which may be activated may include features usable in a selection game, such as additional selections, opportunities to replace or re-do a prior selection, opportunities to undo a poor selection or selection of a terminating symbol, etc. Moreover, the features 374 may include eligibility or participation in enhanced awards, improvements of randomly selected outcomes of a primary wagering game, advancement to higher levels of play, advancement to newer or more favorable episodes of wagering games, etc. In yet other embodiments, features 374 may include eligibility and participation in additional wagering games, other games within a casino or gaming establishment (e.g. other table games or electronic games), wide area progressive jackpots, local area progressive jackpots, tangible prize awards, player reward points and loyalty programs, etc. The features 374 of the gaming system 300 as described herein may comprise any feature available on a wagering game which may be funded by an increased wager, a side wager, a secondary or separate wager, via player reward points, or in any other manner utilizing any form of currency, monetary input or other value.

It should also be understood that the features 374 activated in the system 300 of the present invention may be any number of available wagering game features as described herein. Moreover, the features 374 may include any enhancements or additions to the primary wagering game as described in detail in U.S. Patent Application Ser. No. 60/844,032 filed on Sep. 12, 2006, and U.S. Patent Application Ser. No. 60/802,984 filed on May 24, 2006, both of which are assigned to WMS Gaming Inc. Both such applications are hereby incorporated by reference, in their entirety, as if full set forth herein.

Turning to FIG. 4, a gaming system 400 is displayed which comprises a plurality of gaming device 410*a,b,c* and at least one community display 480 or sign. The gaming devices 410 each display a primary wagering game 460 and include a feature menu 472 displaying a plurality of activatable features 474. Each of the gaming devices 410 is shown as a free standing gaming machine as shown in FIG. 1*a*, but may take on other forms in other alterative embodiments, such as other freestanding gaming devices, a handheld gaming device such as the one in FIG. 1*b*, or other portable and/or mobile gaming devices. In an embodiment, the feature menu 472 on each gaming device 410 displays the same selectable features 474 which may be activated by a player of that gaming device. In an embodiment, activation of one or more of the available features 474 requires the player to place a secondary or side bet.

The community display 480 is mounted in the operator's facility (e.g., a casino) and in an embodiment is proximate to one or more of the gaming devices 410 of the system 400. In an embodiment, the community display 480 is positioned overhead of a bank of two or more gaming devices 410. The community display 480 presents information and game play relating to one or more features 474 which are active on one or more of the gaming devices 410. In an embodiment, the community display 480 is divided into a plurality of display regions 482*a,b,c,d* or zones. A first display region 482*a* displays game play related to a first feature 474*a* activated on the first gaming device 410*a*. A second display region 482*b* displays game play related to a second feature 474*b* activated on the second gaming device 410*b*. A third display region 482*c* displays game play related to a third feature activated on the third gaming device 410*c*. A fourth display region 482*d* displays game information related to a bonus feature, which in this embodiment is a progressive jackpot game.

The various regions 482 on the community display 480 are configured to be various shapes and sizes, and positioned on various portions of the community display 480. The configuration of the display regions 482 is controlled by one or more operator control computers (not shown), which control the size, location, and content of each display region 482 in accordance with one or more rule sets. In the embodiment shown in FIG. 4, the first display region 482*a* is the largest region, and displays game play relating to a "Monopoly" feature 474*a* which has been activated on the first gaming device 410. The "Monopoly" feature 474*a* may be selected by the operator control computer to occupy the largest display region 482 based on any number of criteria, as evaluated by the one or more rule sets employed. For example, in an embodiment, the largest display region 482*a* may be reserved for the active feature 474 which is being played by the largest number of players in the casino. In another embodiment, the largest display region 482*a* may be occupied by the feature 474 generating the most wagers, or paying out the largest prizes.

Similarly, the second and third regions 482*b,c* display game play from features 474*b,c* activated on the other two gaming devices 410*b,c*. In the embodiment shown, the second and third regions 482*b,c* are similarly sized, but smaller than the first region 482*a*. In an embodiment, the rule set may cause the second and third display regions 482*b,c* to be occupied by the remaining active features 474*b,c* in a predetermined fashion, or in a random order. In other words, the rule set may dictate which feature 474 is to occupy the largest region 482*a*, but the other regions 482*b,c* may be occupied by the remaining active features 474*b,c* without regard to any evaluations or performance criteria. Conversely, the rule sets may evaluate the second and third features 474*b,c* for performance criteria and assign the display of such features 474*b,c* to the remaining display regions 482*b,c* in accordance with such evaluation. The fourth display region 482*d* may be used for game information which may or may not appear on the gaming devices 410 of the system 400, such as the progressive jackpots shown in the fourth region 482*d*.

In alternative embodiments, many other criteria may be used and evaluated by the rule set in order to determine which features 474 or other content to assign to the various display regions 482. In one embodiment, all activated features 474 within a set of gaming devices 410 are displayed on one or more regions 482 of the community display 480. Thus, if ten (10) different features 474 are active, all ten (10) are displayed on the community display 480. If only two features 474 are active, then only those two are displayed on the community display 480. In this way, the number of display regions 482 on the community display 480 may vary over time. In an embodiment, each feature 474 may be assigned or associated with one or more priority metrics, which are evaluated by the rule set in determining which feature 474 occupies which display region 482, to ensure that larger or more prominent regions 482 are displaying more active games, for example. In one embodiment, such metric may comprise the number of players playing a feature 474. In another embodiment, an operator selection may override the metrics, such that an operator can choose which features 474 to display in which display regions 482, regardless of how much (if at all) they are being played. In yet another embodiment, a player's location may influence and effect the layout of what content is displayed in the various display regions 482. For example, using one of many techniques for locating a player or gaming device within a casino, the player's location could affect the display region 482 used to display the feature 474 which that player has selected. In one example, a player located to the left of the community display 480 may be assigned a display region 482 on the left side of the display 480.

Moreover, the metrics may include certain time periods associated with various features 474. Thus, a first feature 474 may occupy the largest display region 482*a* for a period of time, and then be moved to another region 482 or replaced by another feature 474. The time periods may be fixed or dynamic, and may be based upon other criteria such as number of players playing the feature, coin in for that feature, etc. The features 474 may also rotate from one region 482 to the next so that each such feature 474 occupies the largest display region 482*a* for a period of time. Other configurations are possible as well.

In yet other embodiments, the game play currently active in the feature 474 may determine which display region 482 (if any) it occupies on the community display 480. For example, if a large award or other triggering event occurs in a first feature 474, that feature 474 may be transferred to the largest display region 482*a* to celebrate the award and generate excitement among players. Other triggering events may be utilized to trigger such a transfer of a feature to a different display region 482, such as a high score being achieved, a record being broken, a big award being provided, a certain number of players winning awards, a certain level or episode being achieved, etc. In another embodiment, if a feature 474 surpasses a theoretical value in which it should be triggered, and is in a sense "overdue", it may be displayed on a prominent region 482 of the community display 480. Many other criteria can be used to trigger the appearance of a feature 474 in a particular display region 482, or the transfer of a feature 474 from one region 482 to another.

Figure 5:
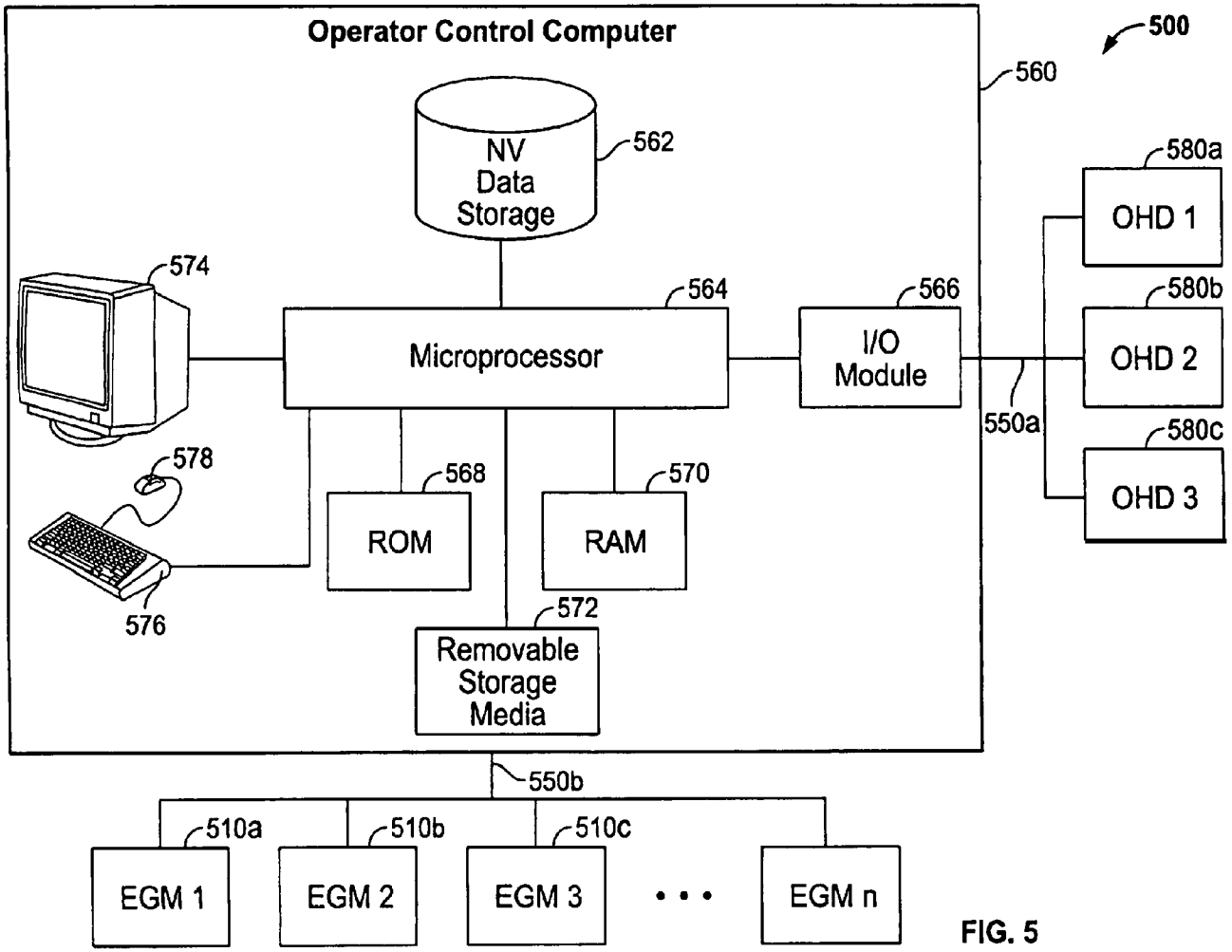
FIG. 5 is a block diagram of a gaming system having controllable dynamic signage and including an operator control computer.

In FIG. 5, a block diagram of gaming system 500 is displayed. The system 500 includes a plurality of gaming devices 510*a,b,c*, such as the gaming devices depicted and described in relation to FIG. 4. Such gaming devices 510*a,b,c* are also referred to herein and in the FIGURES as electronic gaming machines (EGMs). The system 500 further includes a plurality of community displays 580*a,b,c*, such as the community display depicted and described in relation to FIG. 4. Such community displays 580*a,b,c* are also referred to herein and in the FIGURES as overhead displays (OHDs). The community displays 580 and the gaming devices 510 are in communication with an operator control computer 560 over one or more networks 550*a,b*. The networks 550*a,b* may include various subcomponents such as modems, routers, ports, etc. Moreover, the networks 550*a,b* may include wired and wireless components and may permit both wired and/or wireless communications between the community displays 580, the gaming devices 510 and the operator control computer 560.

As seen in FIG. 5, an illustrative operator control computer 560 is shown in which software programs are stored to control the community displays 580 and features displayed thereon. A microprocessor 564 is supported by read-only memory (ROM) 568, random access memory (RAM) 570, a removable storage media 572, and a nonvolatile data storage device 562. The removable storage media 572 may comprise any form of input/output device capable of reading from and/or writing to removable media such as a floppy disk, USB flash module, compact flash card, etc. In the illustrative embodiment, a removable compact flash device holds the kernel/operating system (OS) of the operator control computer 560 and is not writable, e.g. the write-lines are disabled in hardware of the compact flash drive. This enhances security built around the core OS which can be stored on compact flash. The nonvolatile data storage device 562 may comprise any form of nonvolatile storage devices such as a hard drive that is not considered to be removable storage media. The non-volatile storage devices 562 as applicable to this operator control computer 560 are writable. Input devices such as a keyboard 576, mouse 578, etc. can be utilized by an operator or administrator to input information and control instructions. Output devices such as a visual display 574 can be utilized to provide text, characters and graphical information to the administrator of the operator control computer 560. Additional types of known input devices and output devices can be utilized to provide interactive communications with the user of the operator control computer 560. An input/output module 566 is coupled to microprocessor 564 and provides an interface supporting communications between the microprocessor and external devices, such the gaming devices 510 and the community displays 580.

It should be understood that the input devices 576, 578 may be connected to the operator control computer 560 remotely. The computer 560 may be stored in a safe room or secure location and controlled remotely by input devices 576,578 connected directly to the operator control computer 560, or connected over indirectly through an intermediate computer or workstation. It should be further understood that the operator control computer 560 may comprise a plurality of computers and processors matching the computing demands of the system 500 relative to the number of community displays 580 and gaming devices 510. Thus, as the number of gaming devices 510 and community displays 580 increases, the operator control computer 560 may require increased computing capabilities as well.

As will be understood by those skilled in the art, data and stored program instructions in ROM 568 are typically utilized by microprocessor 564 to initialize and boot the computing apparatus. One or more application programs, e.g. gaming programs that controls the implementation of corresponding features and/or games, are stored in storage element 562. At least portions of the active application program will be typically stored in RAM 570 for ready access and processing by microprocessor 564. One or more rule set(s) which govern the display of various features on the various community displays 580 or display regions thereon are stored in memory, such as the nonvolatile storage element 562. The rule set(s) or portions thereof may also be loaded into RAM for ready access by the microprocessor 564, or may be stored on the removable storage media 572. The rule set(s) may be activated, deactivated, initialized, replaced, changed, amended, edited, scheduled or otherwise configured as described herein, to control the display regions of the community displays 580, and the features and content displayed therein.

An operator interface may be displayed on the operator control computer 560, to visually indicate to the operator various portions of the rule set(s) employed, and the priorities being used or evaluated therein. For example, the operator interface may be a menu driven system in which an operators facility or casino floor is broken down by banks of gaming devices, and then individual gaming devices in the bank. The floor may further be broken down by each overhead or community display, and the various display regions thereon. Then different layout schemes may be presented as part of one or more rule sets. For example, each game theme may be displayed with an inherent or base priority, as well as an overall priority as a function of one or more metrics, as explained herein. Each theme may have eligibility to be displayed only on certain community displays, or on all of them. Moreover, each community display may have its own rule set, layout, prioritization, and relationship with other gaming devices and other community displays. The rule sets may be co-dependent such that an operator may, for example, de-prioritize certain content which is prioritized by the rules of a particular community display. The operator interface may be presented graphically (such as with drag and drop elements), via a menu system, via a list, via folders or tabs, or using any other method to display the criteria evaluated by the rule set, and the rule set preferences themselves. Using the operator interface, an operator may adjust the rule set, may replace a rule set with another rule set, may activate additional rule sets, or may activate on or more prepackaged "themes" or groups of rule sets. Moreover, such customization may be adjusted by the operator to be time based, seasonal, etc. such that the variations in the rule sets occurs automatically at certain times, or based upon certain criteria or metrics.

Figure 6:
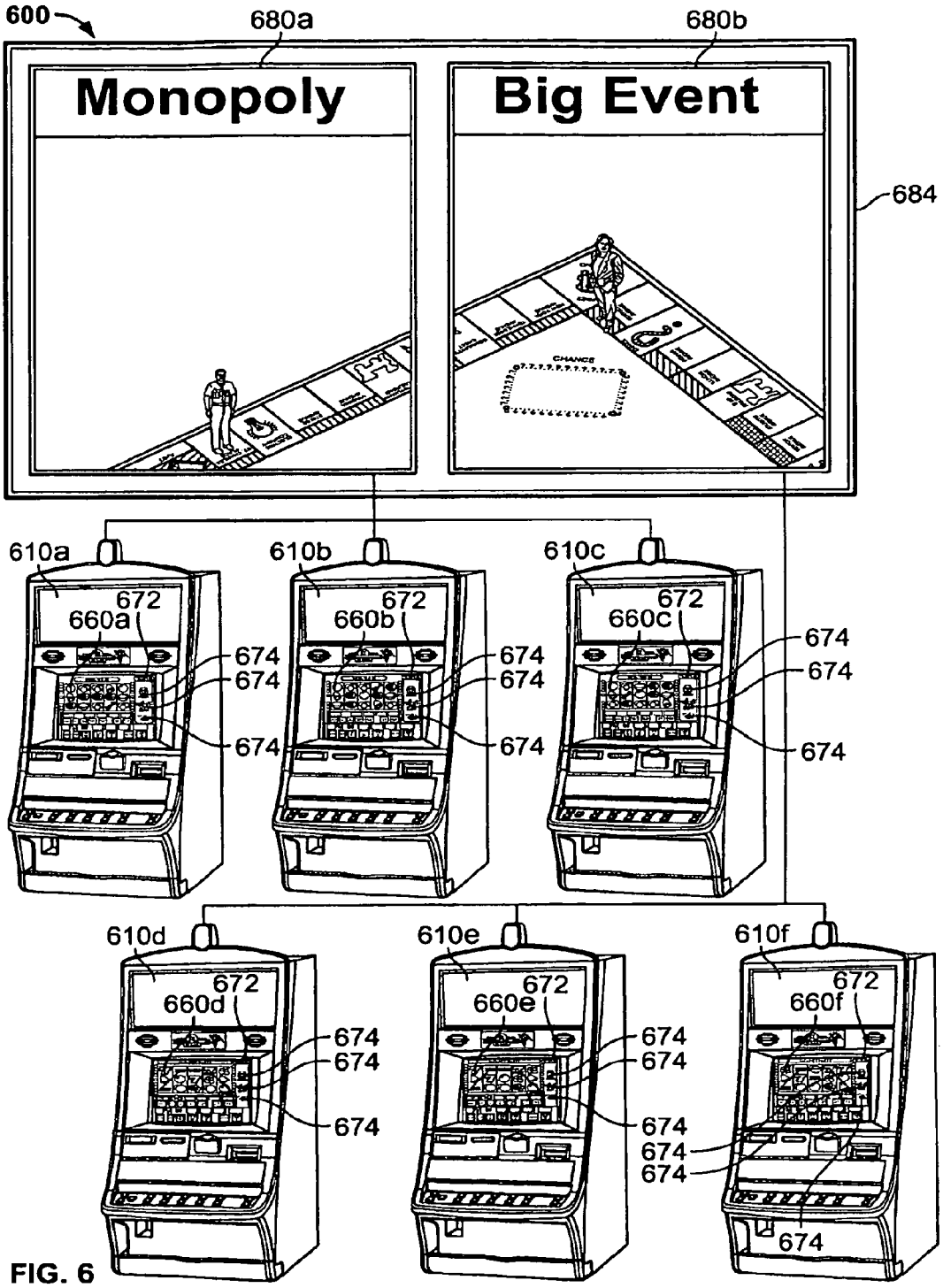
FIG. 6 is a diagram of an alternative embodiment of a gaming system having controllable dynamic signage including a plurality of community displays.

Turning to FIG. 6, an alternate embodiment of a gaming system 600 is depicted. The gaming system 600 includes a plurality of gaming devices 610*a,b,c,d,e,f* and a plurality of community displays 680*a,b*. A first set of the gaming devices 610*a,b,c* is associated with the first community display 680*a* and a second set of gaming devices 610*d,e,f* is associated with the second community display 680*b*. As with other embodiments described herein, each of the gaming devices 610 executes a primary wagering game 660. Moreover, each of the gaming devices 610 includes a feature menu 672 with which a player may activate and play one or more bonus or supplemental features 674. Upon the occurrence of a triggering event, one or more of the features 674 active on any of the gaming devices 610 is displayed on the plurality of community displays 680*a,b* as a coordinated presentation. In one embodiment, as seen in FIG. 6, a selected feature (here the Monopoly Big Event feature) is displayed as a unified image across multiple displays, here the two community displays 680*a,b*. Thus, a triggering event triggers play of the Monopoly Big Event feature which is depicted as a unified display across both community displays 680*a,b*.

In other embodiments, the coordinated presentation on the plurality of community displays 680*a,b* may take on other forms. For example, in competitive features or games, separate teams may be assigned to separate displays 680*a,b* which are then coordinated to display the feature 674. In other embodiments, a coordinated display may involve a collaboration by one or more players or teams which is presented in part on one display 680*a*, and in part on another display 680*b*. In yet other embodiments the coordinated display may involve displaying multiple vantage points, views, or camera angles of a feature or event on the various community displays 680. In this way, the coordination of multiple displays 680 may be configured so as to appear similar to the use of multiple display regions on a single display, as described herein with reference to FIG. 4. In this regard, the system 600 may include a display frame 684 which is adjacent to and/or in between the community displays 680*a,b*. The display frame 684 furthers the illusion that the separate community displays 680*a,b* are one large display divided into regions, when in actuality, the displays 680*a,b* are separate and distinct from one another, but bordered by and separate from one another by the display frame 684. It should be further understood that the community displays 680*a,b* may be further subdivided into display regions which display additional information.

In alternative embodiments, the rule set which controls the community display signage and the display of features thereon may evaluate any number of criteria in determining the layout and inclusion of features on the display. In an embodiment, metrics association with a particular player may be utilized by the rule set. For example, a player's point status, membership level, or other data may be used to determine which features are displayed on a community display, and if so, in what region such feature is displayed. A player having a very high player status, for example, may be permitted to have his activated feature(s) occupy the largest area of a community display, while other lower ranking players are assigned smaller display regions, or none at all. In other embodiments, players enrolled in a player club, or player reward program may be given preferential treatment over players not so enrolled.

In other embodiments, each feature itself may be assigned or allocated an inherent "priority" level which is evaluated by the rule set(s) in determining which display region(s) such feature occupies. For example, the Jackpot Party feature may be assigned a higher priority relative to the Reel Em In feature. Alternatively, or additionally, the priority level of a feature may be adjusted or affected by other criteria or metrics including but not limited to the aforementioned coin-in, award size, player status, popularity, etc. Thus, in an example, even through Jackpot Party has a higher base priority than Reel Em In, if Reel Em In is more popular (higher coin-in for example) at a particular time, it may have a higher overall priority and be assigned the largest display region on a community display. In this way, overall priorities of features are dynamically changing and constantly being evaluated by rule sets. Moreover, this results in constant dynamic adjustment and monitoring of the content of the various display regions on the community displays.

Other criteria may dictate what gets displayed in a particular display region as well. For example, a player may win (as part of a game outcome) control of one or more of the display regions, giving that player the right to assign the content for that region (for a limited time, perhaps). Anticipation criteria may be utilized to display a feature which is close to triggering a large award on a particular display region. Features having multiple levels or episodes may be evaluated and displayed on particular display regions based at least in part upon which level or episode is active in the feature. The rule set may further evaluate the number and type of assets collected by one or more players in the feature in determining whether the feature should be displayed. For example, once players have collected a predetermined number of game assets in a feature (or in an underlying primary wagering game), then the feature becomes eligible for display in one or more display regions on the community display. Evaluation criteria may also include how popular a feature is amongst players, player input (a player can drag and drop a feature to a particular region of the community display), side wagering opportunities (features that allow side bets get a relatively increased priority), etc. Any or all of these various evaluation criteria employed and evaluated by the rule set(s) may have various weighting schemes which may be static or dynamically weighted in response to other events or criteria.

In yet other embodiments, the community display and the display regions thereon may be controlled in part, or affected by external devices such as RFID tags, mobile devices, player identification devices, biometric identifiers, mobile telephones, etc. Thus, for example, when an associated device (such as a player's cellular phone or ID card) is detected within a certain proximity of a community display, it may signal to the system that the player is nearby, and based upon a certain priority or other rules, one or more regions of the community display may be dedicated to that player. In an embodiment, a player who has the largest point total or other metric, may be assigned the largest display region of the community display. In other embodiments, players in the vicinity may all share equally and receive similar size display regions in which to watch their activated features or other information appear on the community display.

Various animation and motion techniques may be utilized on the community displays to refresh, adjust, and move the display regions. For example, picture in picture and scrolling techniques may be used to move one feature from a first region to a second region. Moreover, various regions and the features displayed therein may be relocated, translated, rotated, resized, or removed altogether from the community display. Alternatively, the community display can employ fixed size display regions and the content therein may be refreshed, altered or amended in various ways.

Other content may be published on one or more regions of the community display as well. For example, casino information, promotions or advertisements may be assigned by the rule set to various display regions of various community displays for certain amounts of time, or based upon other criteria. Other nongaming content may occupy one or more display regions, such as sports scores, video displays, graphics displays, etc. Moreover, operators may configure the system to include display of one or more operator specific games, features, or bonuses. Thus, for example, Harrah's casinos may have a dedicated display region in which Harrah's displays its own bonus features, contests, player rewards information, etc. It should also be understood that the display regions on the community display may be distinct and discreet as shown in the FITGURES, or may be overlapping in part or in whole.

In an embodiment, video displayed on one or more individual gaming devices may be coordinated or synchronized. Video displayed on a gaming device may be rendered by the device itself, or may be rendered remotely by a central controller or other components of the system. Video rendered for the various display regions of the community displays may be rendered centrally by the operator control computer, or other central components of the system. Synchronization can be accomplished by scheduling displays of various features, or portions thereof, so that portions are simultaneously displayed on individual gaming devices and display regions of various community displays. In this way, the system may be utilized to create unified or coordinated displays locally on gaming devices and globally on community displays. A master controller for all community displays may be in communication with the operator control computer so as to permit scheduling of such joint or coordinated displays.

Various audio programs may be utilized with the various embodiments of the invention. In one version, each feature is associated with an audio track. Audio transmitted by or proximate a community display may be controlled by one or more portions of the rule set(s). In an embodiment, the feature occupying the largest display region on a community display will also control the audio, such that its associated audio is transmitted by the system. On another embodiment, the rule set may evaluate other metrics or criteria in order to determine which audio is transmitted by the system. Each individual gaming device in the system may transmit its own audio, which may be the same, similar, or different from the audio associated with the features being displayed on a community display. In this way, the community display may be controlled to present a coordinated audio program in conjunction with audio transmitted by individual gaming devices or other audio components of the system.

The systems, devices and methods described herein offer a number of benefits and advantages over traditional gaming systems. The use of community displays and signage having a plurality of display regions permits a plurality of features to be simultaneously presented to players. This permits the displays to capture a larger audience of players who may have a variety of viewing preferences which cannot be satisfied by a single displayed event. Various features or portions thereof may occupy various display regions and may be moved from one region to another based upon criteria and metrics monitored by an operator control computer. One or more rule sets may evaluate such criteria or metrics and change the display of the features in the various regions of the community displays in response thereto to ensure that the most enjoyable viewing experience is delivered to each community display. This provides a community display which attracts the most player viewing and delivers the most entertaining and relevant content. The rule set(s) stored and administered by the operator control computer allow customization of the system such that maximum visual effect is achieved at all times. Moreover, the use of multiple displays in a coordinated display of events permits larger plasma and LCD displays to be utilized. Other benefits of the present invention are provided as well.

Each of these embodiments and obvious variations thereof is contemplated as falling within the spirit and scope of the claimed invention, which is set forth in the following claims.

What is claimed is:

1. A gaming system comprising:

a community display device having a plurality of display regions thereon;

at least one processor; and at least one memory device storing instructions that, when executed by the at least one processor, cause the gaming system to:

(i) detect activation of a first supplemental feature by a first player playing a first primary wagering game at a first gaming device distinct from the community display device;

(ii) detect activation of a second supplemental feature by a second player playing a second primary wagering game at a second gaming device distinct from the community display device, the first supplemental feature and the second supplemental feature being gameplay features of at least one of the first primary wagering game and the second primary wagering game;

(iii) assign the first and second supplemental features to respective first and second display regions of the plurality of display regions in accordance with at least a first rule set; and (iv) display the first and second supplemental features in the respective assigned first and second display regions.

2. The system of claim 1, wherein the first display region is larger than the second display region.

3. The system of claim 1, further comprising an operator control computer including the processor and the memory device, the operator control computer being in communication with the community display device, wherein the first rule set is stored in the memory device.

4. A gaming system comprising:

a community display device having a plurality of display regions thereon;

at least one processor; and at least one memory device storing instructions that, when executed by the at least one processor, cause the gaming system to:

(i) detect activation of a first supplemental feature by a first player;

(ii) detect activation of a second supplemental feature by a second player, the first supplemental feature and the second supplemental feature being gameplay features of at least one of a first primary wagering game and a second primary wagering game;

(iii) assign the first and second supplemental features to respective first and second display regions of the plurality of display regions in accordance with at least a first rule set; and (iv) display the first and second supplemental features in the respective assigned first and second display regions;

wherein the first and second supplemental features are displayed along with one or more of a plurality of additional activatable supplemental features.

5. A gaming system comprising:

a community display device having a plurality of display regions thereon;

at least one processor; and at least one memory device storing instructions that, when executed by the at least one processor, cause the gaming system to:

(i) detect activation of a first supplemental feature by a first player;

(ii) detect activation of a second supplemental feature by a second player, the first supplemental feature and the second supplemental feature being gameplay features of at least one of a first primary wagering game and a second primary wagering game;

(iii) assign the first and second supplemental features to respective first and second display regions of the plurality of display regions in accordance with at least a first rule set; and (iv) display the first and second supplemental features in the respective assigned first and second display regions;

wherein the first and second supplemental features are associated with respective different priority levels, the first and second supplemental features being assigned to the respective first and second display regions based, at least in part, on the priority levels.

6. A gaming system comprising:

a community display device having a plurality of display regions thereon;

at least one processor; and at least one memory device storing instructions that, when executed by the at least one processor, cause the gaming system to:

(i) detect activation of a first supplemental feature by a first player;

(ii) detect activation of a second supplemental feature by a second player, the first supplemental feature and the second supplemental feature being gameplay features of at least one of a first primary wagering game and a second primary wagering game;

(iii) assign the first and second supplemental features to respective first and second display regions of the plurality of display regions in accordance with at least a first rule set; and (iv) display the first and second supplemental features in the respective assigned first and second display regions;

wherein the first rule set evaluates a set of metrics to determine content for each of the plurality of display regions.

7. A gaming system comprising:

at least one community display device having a plurality of display regions thereon; and an operator control computer in communication with the at least one community display device, the operator control computer comprising at least one memory device storing at least a first rule set for controlling the plurality of display regions and resolving which of a plurality of activatable supplemental features is displayed in each of the plurality of display regions;

wherein the activatable supplemental features include a first supplemental feature by a player and a second supplemental feature by a second player, the first player playing a first primary wagering game at a first gaming device distinct from the community display device, the second player playing a second primary wagering game at a second gaming device distinct from the community display device.

8. The system of claim 7, wherein each of the activatable supplemental features is associated with a base priority level and an overall priority level.

9. The system of claim 8, wherein each of the plurality of display regions displays at least one activated supplemental feature.

10. The system of claim 8, wherein the at least one activated supplemental feature is selected from the plurality of activatable supplemental features.

11. The system of claim 7, wherein a first one of the plurality of display regions is larger than the remainder of the plurality of display regions.

12. A gaming system comprising:

at least one community display device having a plurality of display regions thereon; and an operator control computer in communication with the at least one community display device, the operator control computer comprising at least one memory device storing at least a first rule set for controlling the plurality of display regions and resolving which of a plurality of activatable supplemental features is displayed in each of the plurality of display regions;

wherein each of the activatable supplemental features is associated with a base priority level and an overall priority level;

wherein the first rule set evaluates the base priority level and overall priority level of each of the activatable supplemental features.

13. A gaming system comprising:

at least one community display device having a plurality of display regions thereon; and an operator control computer in communication with the at least one community display device, the operator control computer comprising at least one memory device storing at least a first rule set for controlling the plurality of display regions and resolving which of a plurality of activatable supplemental features is displayed in each of the plurality of display regions;

wherein the activatable supplemental features include first and second supplemental features associated with respective different priority levels, the first and second supplemental features being assigned, respectively, to a first and second display regions of the plurality of display region based, at least in part, on the priority levels.

14. A computer-implemented method in a gaming system, comprising:

displaying on at least one community display device a plurality of display regions;

detecting, by one or more processors, activation of a first supplemental feature by a first player playing a first primary wagering game at a first gaming device distinct from the community display device;

detecting, by at least one of the one or more processors, activation of a second supplemental feature by a second player playing a second primary wagering game at a second gaming device distinct from the community display device, the first supplemental feature and the second supplemental feature being gameplay features of at least one of the first primary wagering game and the second primary wagering game;

assigning, by at least one of the one or more processors, the first and second supplemental features to respective first and second display regions of the plurality of display regions in accordance with at least a first rule set; and displaying the first and second supplemental features in the respective assigned first and second display regions.

15. The method of claim 14, wherein the first display region is larger than the second display region.

16. A computer-implemented method in a gaming system, comprising:

displaying on at least one community display device a plurality of display regions;

detecting, by one or more processors, activation of a first supplemental feature by a first player;

detecting, by at least one of the one or more processors, activation of a second supplemental feature by a second player, the first supplemental feature and the second supplemental feature being gameplay features of at least one of a first primary wagering game and a second primary wagering game;

assigning, by at least one of the one or more processors, the first and second supplemental features to respective first and second display regions of the plurality of display regions in accordance with at least a first rule set;

displaying the first and second supplemental features in the respective assigned first and second display regions; and displaying, by at least one of the one or more processors, the first and second supplemental features along with one or more of a plurality of additional activatable supplemental features.

17. A computer-implemented method in a gaming system, comprising:

displaying on at least one community display device a plurality of display regions;

detecting, by one or more processors, activation of a first supplemental feature by a first player;

detecting, by at least one of the one or more processors, activation of a second supplemental feature by a second player, the first supplemental feature and the second supplemental feature being gameplay features of at least one of a first primary wagering game and a second primary wagering game;

assigning, by at least one of the one or more processors, the first and second supplemental features to respective first and second display regions of the plurality of display regions in accordance with at least a first rule set;

displaying the first and second supplemental features in the respective assigned first and second display regions; and assigning the first and second supplemental features to the respective first and second display regions based, at least in part, on different priority levels associated, respectively, with the first and second supplemental features.

18. A computer-implemented method in a gaming system, comprising:

displaying on at least one community display device a plurality of display regions;

detecting, by one or more processors, activation of a first supplemental feature by a first player;

detecting, by at least one of the one or more processors, activation of a second supplemental feature by a second player, the first supplemental feature and the second supplemental feature being gameplay features of at least one of a first primary wagering game and a second primary wagering game;

assigning, by at least one of the one or more processors, the first and second supplemental features to respective first and second display regions of the plurality of display regions in accordance with at least a first rule set;

displaying the first and second supplemental features in the respective assigned first and second display regions; and evaluating, by at least one of the one or more processors, a set of metrics to determine content for each of the plurality of display regions.

19. A computer-implemented method in a gaming system, comprising:

displaying on at least one community display device a plurality of display regions;

in response to an input by a first player via a first input device of a first gaming device distinct from the community display device, activating, by one or more processors, a first supplemental feature;

in response to an input by a second player via a second input device of a second gaming device distinct from the community display device, activating, by one or more processors, a second supplemental feature, the first supplemental feature and the second supplemental feature being gameplay features of at least one of a first primary wagering game and a second primary wagering game;

assigning, by at least one of the one or more processors, the first and second supplemental features to respective first and second display regions of the plurality of display regions in accordance with at least a first rule set; and displaying the first and second supplemental features in the respective assigned first and second display regions.

* * * * *

UNITED STATES PATENT AND TRADEMARK OFFICE

CERTIFICATE OF CORRECTION

PATENT NO. : 8,821,278 B2
APPLICATION NO. : 13/523375
DATED : September 2, 2014
INVENTOR(S) : Mark B. Gagner et al.

It is certified that error appears in the above-identified patent and that said Letters Patent is hereby corrected as shown below:

In the Claims

Column 20, Line 18 (Claim 10, Line 1), delete the number "8" insert -- 9 --, therefor.

Signed and Sealed this
Seventeenth Day of February, 2015

Michelle K. Lee

Michelle K. Lee
*Deputy Director of the United States Patent and Trademark Office*